US012152848B2

(12) United States Patent
Seidl et al.

(10) Patent No.: US 12,152,848 B2
(45) Date of Patent: Nov. 26, 2024

(54) REPEATING WEAPON

(71) Applicant: Blaser Group GmbH, Isny (DE)

(72) Inventors: Paul Seidl, Argenbühl (DE); Martin Vetter, Ulm (DE)

(73) Assignee: Blaser Group GmbH, Isny (DE)

( * ) Notice: Subject to any disclaimer, the term of this patent is extended or adjusted under 35 U.S.C. 154(b) by 0 days.

(21) Appl. No.: 18/105,957

(22) Filed: Feb. 6, 2023

(65) Prior Publication Data

US 2023/0400273 A1 Dec. 14, 2023

(30) Foreign Application Priority Data

Feb. 7, 2022 (DE) ..... 10 2022 102 807.0

(51) Int. Cl.
*F41A 17/58* (2006.01)
*F41A 17/42* (2006.01)
(Continued)

(52) U.S. Cl.
CPC ..... *F41A 17/58* (2013.01); *F41A 17/42* (2013.01); *F41A 19/10* (2013.01); *F41A 19/12* (2013.01); *F41A 19/16* (2013.01)

(58) Field of Classification Search
CPC ..... F42A 17/42; F42A 17/46; F42A 17/52; F42A 17/569; F42A 17/58; F42A 19/10; F42A 19/12
(Continued)

(56) References Cited

U.S. PATENT DOCUMENTS 4,471,551 A 9/1984 Mattarelli
5,465,518 A 11/1995 Blaser
(Continued)

FOREIGN PATENT DOCUMENTS

AT 507 904 A4 9/2010
DE 3740940 A1 2/1989
(Continued)

OTHER PUBLICATIONS

Result of Examination Report for German Patent Application No. 10 2022 102 809.7, filed Feb. 7, 2022.
(Continued)

*Primary Examiner* — Bret Hayes
(74) *Attorney, Agent, or Firm* — Paul D. Bianco; Katharine Davis Wong; Fleit Intellectual Property Law

(57) ABSTRACT

A repeating weapon includes a bolt with a bolt body movable between locked and unlocked positions, and a trigger mechanism with a trigger, a sear movable between cocked and half-cocked positions, a transfer element movable by actuation of trigger between a holding position to hold the sear in the cocked position and a release position to move the sear into the half-cocked position, and a breech catch element movable transversely to the bolt body to limit the axial movement of bolt during opening. A control cam is arranged on the bolt body for moving the breech catch element into a safe position when the bolt body is moved into the unlocked position, and a blocking element cooperating with the transfer element is arranged on the breech catch element for preventing movement of the transfer element into the release position when the breech catch element moves into the safe position.

15 Claims, 7 Drawing Sheets

(51) Int. Cl.
*F41A 19/10* (2006.01)
*F41A 19/12* (2006.01)
*F41A 19/16* (2006.01)

(58) Field of Classification Search
USPC ..... 89/27.12; 42/70.04, 70.05, 70.06, 70.09
See application file for complete search history.

(56) References Cited

U.S. PATENT DOCUMENTS

| | | | | |
|---|---|---|---|---|
| 5,502,914 | A * | 4/1996 | Moon | F41A 19/35 42/69.02 |
| 6,813,854 | B2 | 11/2004 | Popikow | |
| 7,165,350 | B2 | 1/2007 | Popikow | |
| 8,656,620 | B2 | 2/2014 | Hankel et al. | |
| 8,677,666 | B2 | 3/2014 | Pichler | |
| 8,966,802 | B1 * | 3/2015 | Findlay | F41A 19/12 42/69.01 |
| 2001/0016997 | A1 | 8/2001 | Zeh | |
| 2002/0104248 | A1 * | 8/2002 | Szabo | F41A 17/26 42/70.01 |
| 2004/0093782 | A1 * | 5/2004 | Popikow | F41A 19/20 42/41 |
| 2005/0188577 | A1 | 9/2005 | Popikow | |
| 2023/0251052 | A1 | 8/2023 | Seidl | |
| 2023/0375296 | A1 | 11/2023 | Seidl | |

FOREIGN PATENT DOCUMENTS

| | | | |
|---|---|---|---|
| DE | 44 13 685 | A1 | 10/1994 |
| DE | 198 10 787 | A1 | 9/1999 |
| DE | 102 35 282 | A1 | 2/2004 |
| DE | 10 2004 041 054 | B3 | 3/2006 |
| DE | 20 2011 002 579 | U1 | 5/2012 |
| DE | 10 2014 102 774 | B3 | 12/2014 |
| DE | 20 2015 101 485 | U1 | 6/2016 |
| EP | 0072 851 | B1 | 1/1985 |
| EP | 0408798 | A1 | 1/1991 |
| FR | 2846737 | A1 | 5/2004 |
| FR | 3043767 | A1 | 5/2017 |
| FR | 3070483 | B1 | 9/2019 |
| RU | 2677165 | C1 | 1/2019 |
| WO | 2021/122443 | A1 | 6/2021 |

OTHER PUBLICATIONS

Search Report for German Application No. 10 2022 102 808.9, filed Feb. 7, 2022.
Office Action dated Jan. 8, 2024 for U.S. Appl. No. 18/205,925.
Result of Examination Report for German Patent Application No. 10 2022 102 807.0, filed Feb. 7, 2022.

* cited by examiner

REPEATING WEAPON

FIELD OF THE INVENTION

The invention relates to a repeating weapon.

BACKGROUND

A trigger mechanism of a small arm is known from DE 20 2015 101 485 U1 with a trigger housing, a trigger arranged to be pivotable in the trigger housing between an initial position and a discharge position, a sear arranged to be pivotable in the trigger housing between a holding position and a half-cocked position and cooperating with the trigger, and a breech catch element arranged to be displaceable on the trigger housing to limit the axial movement of the bolt during opening. The trigger mechanism also has an adjustment mechanism to change the trigger weight. The trigger mechanism, however, requires increased care during handling precisely at limited trigger weights.

SUMMARY

One aspect of the invention relates to a repeating weapon which has improved safety against unintended discharge.

Accordingly, a repeating weapon and expedient embodiments and advantageous further refinements thereof are disclosed herein.

The repeating weapon according to the invention has a bolt with a bolt body movable between a locked position and an unlocked position and a trigger mechanism with a trigger, a sear movable between a cocked position and a half-cocked position, a transfer element movable by actuation of the trigger between a holding position to hold the sear in the cocked position and a release position to move the sear into the half-cocked position, and a breech catch element movable transverse to the bolt body to limit the axial movement of the bolt during opening. A control cam is arranged on the bolt body to move the breech catch element into a safe position when the bolt body is moved into the unlocked position, and a blocking element cooperating with the transfer element is arranged on the breech catch element to prevent the movement of the transfer element into the release position when the breech catch element is moved into the safe position. Unintended discharge during rapid repeating with a still unlocked bolt can thereby be prevented. Discharge is only made possible when the bolt is again fully locked after repeating. In this way, increased safety is achieved.

The blocking element is advantageously arranged on the breech catch element so that the transfer element is spaced from the trigger in the safe position of the breech catch element. Thus, the trigger is completely separated and decoupled from the transfer element when the bolt is opened, so that actuation of the transfer element via the trigger is not possible with the bolt unlocked. Only when the bolt is again fully locked can a connection occur between the trigger and the transfer element to actuate the sear.

The transfer element can preferably be designed in the form of a rotatable rocker with a first arm cooperating with the trigger and the breech catch element via the blocking element and a second arm cooperating with the sear. A first stop can be arranged on the first arm of the transfer element to engage with a first counter stop on the trigger, and a second stop can be arranged on the second arm to engage with a second counter stop on the sear.

The second stop on the second arm of the transfer element and the counter stop on the sear are expediently designed so that the sear pivotable about a transverse pin can be moved downward into a half-cocked position by a counterclockwise rotation of the transfer element.

In a structurally expedient implementation, the blocking element can be designed in the form of a blocking pin arranged in transverse bores of the breech catch element. The breech catch element can be moved into a lower disassembly position through a control slide via a lever. The bolt can therefore be pulled out rearward from a bolt sleeve for disassembly.

The control cam is expediently designed as a radial groove arranged on the outside of the bolt body with a control surface to move the breech catch element into the safe position. The control surface can have a first control surface for contact of the breech catch element in a breech catch position and a second control surface recessed relative to the first control surface for contact of the breech catch element in the raised safe position relative to the breech catch position.

In a further advantageous refinement, the trigger mechanism can have a safety device assigned to the trigger with two pendulums pivotable by impact, wherein the two pendulums are connected to the trigger so that the trigger is forced by at least one of the two pendulums into its initial position during an excursion of the two pendulums caused by impact. The trigger mechanism therefore has an impact or drop safety that is effective in all directions and by means of which unintended discharge in the event of impacts, shocks or the like can be prevented. The force exerted on the trigger by the two pendulums during their excursion increases the force required to actuate the trigger. The higher the percussive forces acting on the trigger mechanism or small arm, the greater the increase in trigger resistance to prevent unintentional discharge. Thus, a further improvement in safety can be achieved.

According to an expedient embodiment, the two pendulums arranged to pivot about a transverse axis in the trigger housing are designed as eccentrically mounted inertial bodies whose center of gravity is offset upward relative to the transverse axis and forward, as seen in the direction of firing. As a result, the pendulums execute a pivoting movement about the transverse axis when the trigger housing is struck.

The two pendulums can be arranged, in a favorably configured and space-saving design, to be rotatable about a common axis of rotation via a transverse bore and a transverse pin. However, the two pendulums can also have separate axes of rotation. The two pendulums have an identical basic shape, but can also be designed differently.

The one pendulum can have on its back end surface, as seen in the direction of firing, a first pressure element offset in a first direction relative to the transverse axis for contact against the trigger and a first spring for pressing the first pressure element against the trigger; and the second pendulum can have on its back end surface, as seen in the direction of firing, a second pressure element offset in a second direction opposite the first direction relative to the transfer axis and a second spring for pressing the second pressure element against the trigger.

The pendulums can expediently have on their back end surface an upper blind bore arranged above the axes of rotation and a lower blind bore arranged beneath the axis of rotation, in each of which a spring and a pressure element are arranged.

The pressure elements preferably consist of rubber or a similar elastic material. However, they can also consist of another material.

BRIEF DESCRIPTION OF THE DRAWINGS

Further details and advantages of the invention are apparent from the following description of a preferred embodiment example with reference to the drawing. In the drawing.

DETAILED DESCRIPTION

Figure 1:
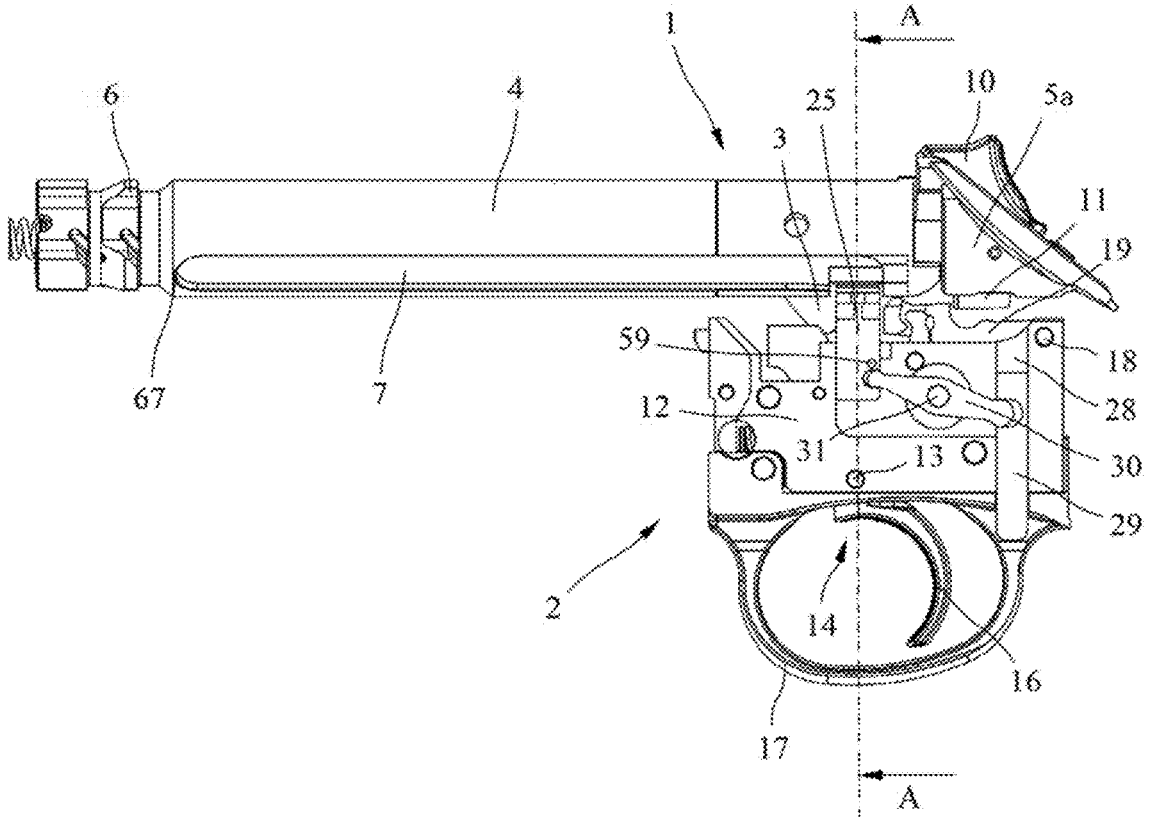
FIG. 1 shows a bolt and a trigger mechanism of a repeating weapon in a side view.

FIG. 1 shows a part of a repeating weapon that contains a bolt breech with an axially movable bolt 1 and a trigger mechanism 2. The bolt 1 contains a cylindrical bolt body 4 axially displaceable within a breech housing by means of a bolt handle 3 and rotatable about the center axis between a locked position and an unlocked position, and a rear portion 5*a* of a bolt sleeve arranged on its rear end. A plurality of locking lugs 6 are provided on the front end of the cylindrical bolt body 4 in known fashion to lock bolt 1 in the breech housing, a receiver sleeve or in a barrel. An axial guide groove 7 is arranged on the outside of the cylindrical bolt body 4.

Figure 2:
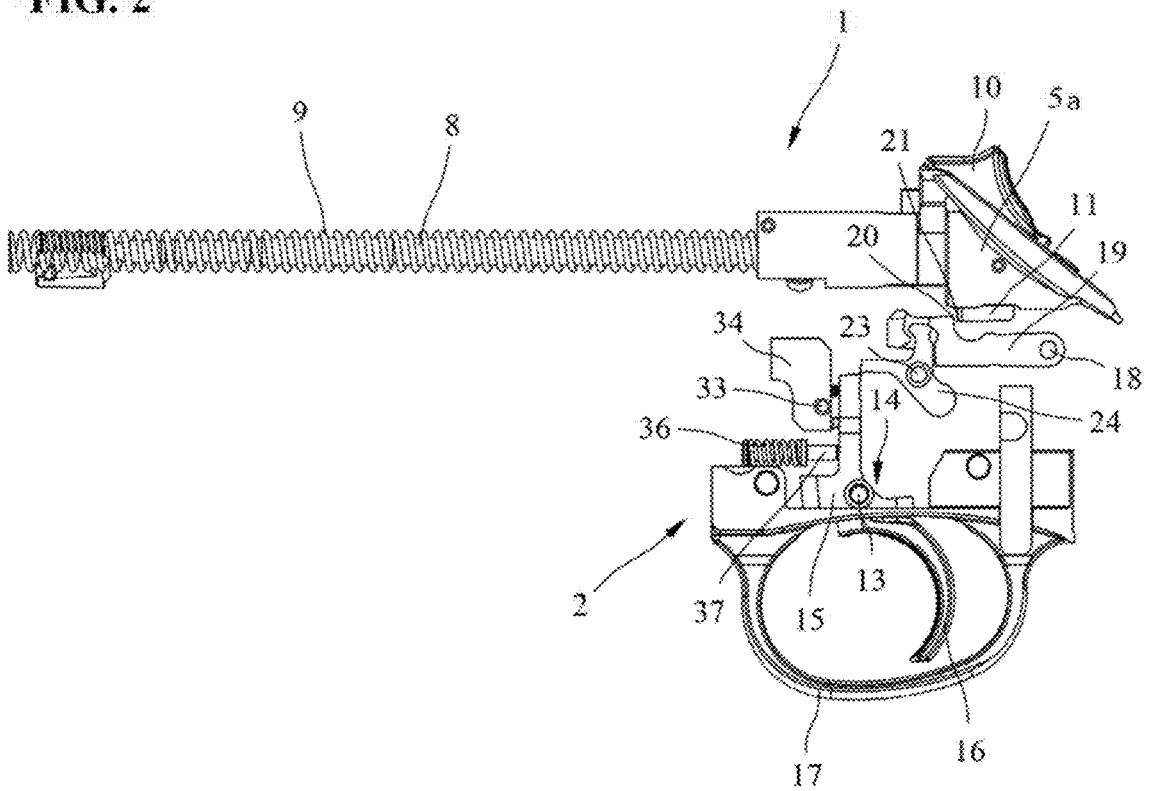
FIG. 2 shows the bolt and the trigger mechanism shown in FIG. 1 with partially blanked out parts in a side view.

A firing pin 8 shown in FIG. 2 and a firing pin spring 9 arranged coaxially around the firing pin 8 are guided axially displaceably in the bolt body 4 and rear portion 5*a* of boat sleeve 5 of bolt 1. A thumb-operated cocking slide 10 is arranged on rear portion 5*a* of bolt sleeve 5 of bolt 1 to cock the firing pin spring 9. A firing pin nut 11 guided to be displaced axially within rear portion 5*a* of bolt sleeve 5 is fastened on the rear end of the firing pin 8.

Figure 3:
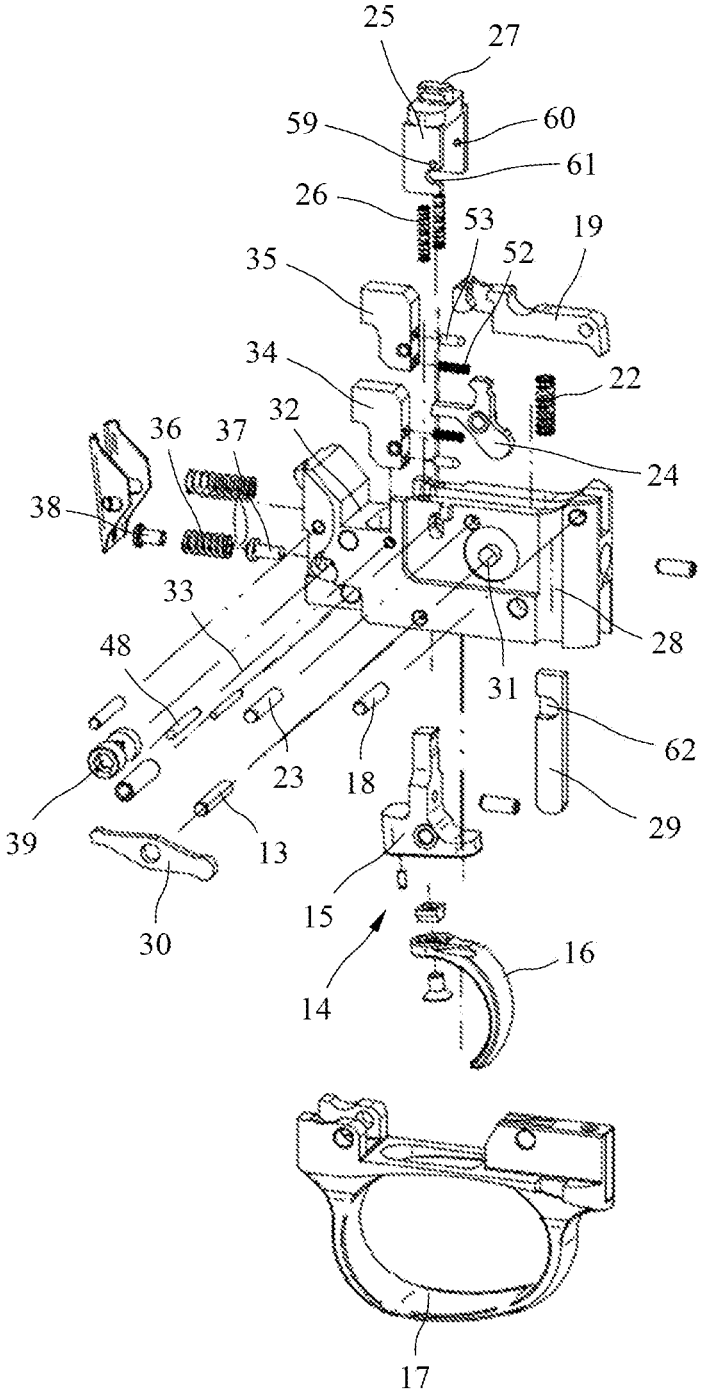
FIG. 3 shows the trigger mechanism shown in FIG. 1 of a repeating weapon in an exploded view.

The trigger mechanism 2 also shown in FIG. 3 in an exploded view contains a trigger 14 pivotable within a trigger housing 12 about a first transverse pin 13, which in the depicted embodiment example consists of a trigger blade carrier 15 rotatable about the first transverse pin 13 and a trigger latch 16 releasably fastened to the bottom of trigger blade carrier 15. A trigger guard 17 is fastened to the bottom of the trigger housing 12. The trigger mechanism 2 also contains a sear 19 pivotable in trigger housing 12 about a second transverse pin 18, which contains a sear stop 20, shown in FIG. 2, to engage with a stop edge 21 of the firing pin nut 11. The sear 19 is forced upward into a cocked position in the direction of firing pin nut 11 via a spring 22, shown in FIG. 3.

In order for the sear 19 to be moved by actuation of trigger 14 from its upper cocked position for holding of the firing pin nut 11 into a lower half-cocked position for release of the firing pin nut 11, a rocker-like transfer element 24 pivotable about a third transverse pin 23 is provided within trigger housing 12 between trigger 14 and sear 19. The rocker-like transfer element 24 is movable between a holding position to hold the sear 19 in the cocked position and a release position to move the sear 19 into the half-cocked position.

As shown in FIG. 1, a fork-like breech catch element 25 is arranged on the trigger housing 12 so as to be displaceable transversely to bolt 1. The breech catch element 25 is forced upward by compression springs 26 shown in FIG. 3 and has a pin 27 on its top to engage in the guide groove 7 on the outside of bolt body 4. Lowering of the breech catch element 25, also shown in FIG. 4, can occur through a control slide 29 guided to move in a guide groove 28 on the side of the trigger housing 12 via a lever 30 mounted to rotate on trigger housing 1. The lever 30 is designed as a double-arm lever that can be pivoted centrally about a pivot 31, so that the breech catch element 25 can be lowered by raising the control slide 29 for disassembly of bolt 1.

As can be seen from FIG. 3, two pendulums 34 and 35, pivotable about a transverse axis 33 by means of a transverse pin 48, are arranged in a recess 32 on the top of trigger housing 12. These pendulums 34 and 35 form a part of an impact or drop safety device, which will be explained in more detail below.

The trigger 14 is movable between an initial position shown in FIG. 2 and a retracted discharge position. The trigger 14 is pressed into the initial position via a pressure pin 37 by means of a trigger spring 36, shown in FIGS. 2 and 3. In the embodiment shown, the trigger spring 36, designed here as a helical compression spring, sits within a longitudinal bore running through the trigger housing 1 in the longitudinal direction thereof and is compressed between the pressure pin 37 and a spring pin 38, which bears against a bolt-shaped control element 39 arranged in trigger housing 12 for altering the trigger weight. A plurality of circumferentially distributed adjustment surfaces are provided on the bolt-shaped control element 39 for varying the bias of the trigger spring 36.

Figure 4:
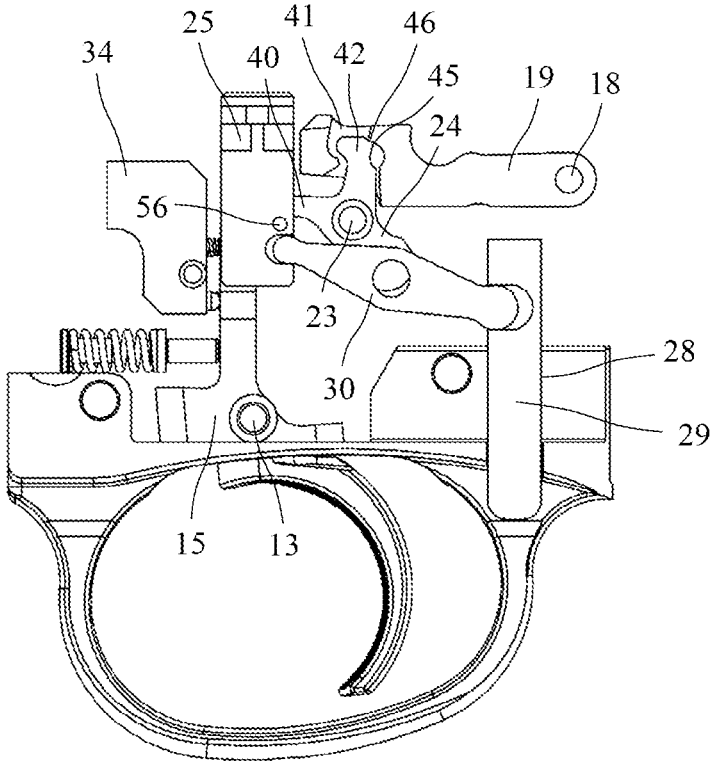
FIG. 4 shows a part of the trigger mechanism shown in FIG. 3 in a side view.
Figure 5:
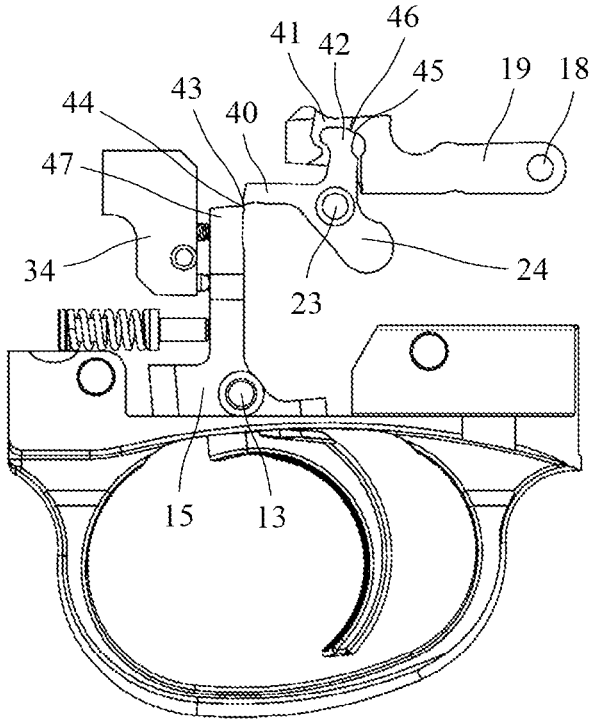
FIG. 5 shows the trigger mechanism shown in FIG. 4 with blanked out components in a side view.
Figure 6:
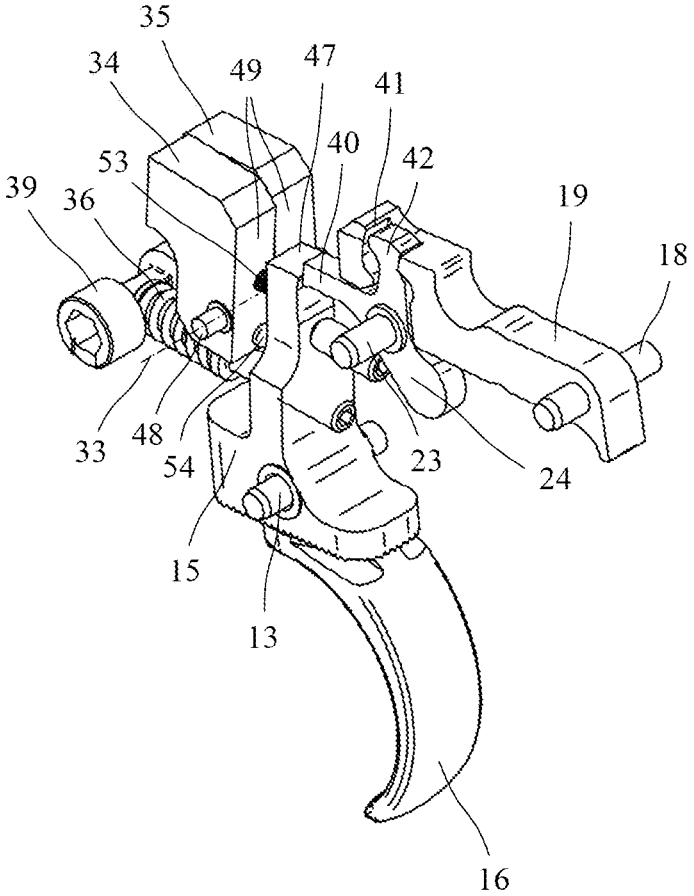
FIG. 6 shows a part of the trigger mechanism shown in FIG. 3 in a perspective view.

As shown in FIGS. 4 and 5, the rocker-like transfer element 24, rotatable about the third transverse pin 23, has a forward extending first arm 40, as seen in the direction of firing and an upward extending second arm 42 engaging in a recess 41 of sear 19. A lower first stop 43 is provided on the front end of the forward extending first arm 40 to engage with a first counter stop 44 on trigger 14. The first counter stop 44 is arranged on an upwardly extending part 47 of the trigger blade carrier 15 pivotable about the transverse axis 13. An upper second stop 45 is provided on the upwardly extending second arm 42 of the rocker-like transfer element 24 rotatable about transverse axis 23 for engagement with a forward protruding second counter stop 46 in the recess 41 of sear 19. The second stop 45 on the second arm 42 of the transfer element 24 and the counter stop 46 in recess 41 of sear 19 are designed such that the sear 19, pivotable about transverse pin 18, can be moved downward into a half-cocked position by a counterclockwise rotation of the transfer element 24.

Figure 7:
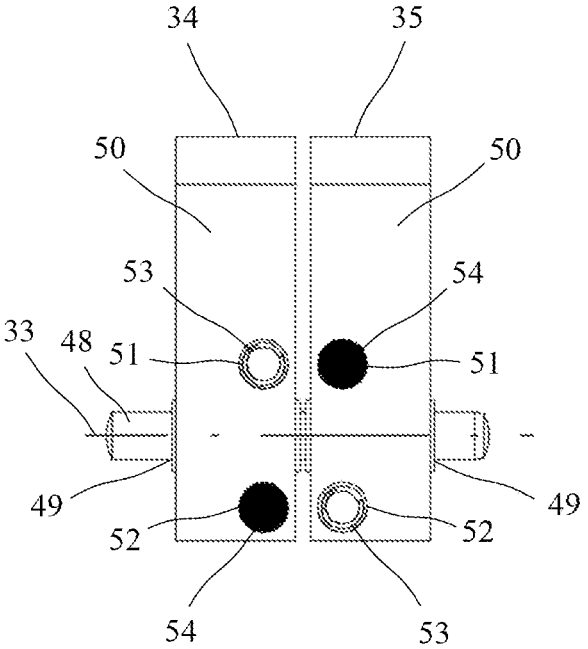
FIG. 7 shows a rear view of two pendulums of the trigger mechanism shown in FIG. 3.

The two pendulums 34 and 35, mounted to pivot in trigger housing 12 through a transverse pin 48 about pivot axis 33 and shown separately in a rear view in FIG. 7, each have a transverse bore 49 to accommodate transverse pin 48. The two angular pendulums 34 and 35 are designed as eccentrically mounted inertial bodies, so that their center of gravity is offset upward relative to transverse axis 33 and forward, as seen in the direction of firing. The pendulums 34 and 35 therefore execute a pivoting movement about transverse axis 33 during impacts on trigger housing 12. The pendulums 34 and 35 each contain on their rear end surfaces 50 facing the upper part 47 of trigger blade carrier 15, as seen in the direction of firing, an upper blind bore 51 arranged above the transverse bore 49 and a lower blind bore 52 arranged beneath the transverse bore 49. A first spring 53 is arranged in the upper blind bore 51 of the left pendulum 34, as seen in the direction of firing, for contact against the upper part 47 of the trigger blade carrier 15, and a first pressure element 54 designed here pin-like is arranged in the lower blind bore 52 of the left pendulum 34, as seen in the direction of firing, for contact against the upper part 47 of the trigger blade carrier 15. On the other hand, a second pressure element 54, here designed pin-like, is arranged in the upper blind bore 51 of the right pendulum 35, as seen in the direction of firing, for contact against the upper part 47 of the trigger blade carrier 15, and a second compression spring 53 is arranged in the lower blind bore 52 of the right pendulum 35, as seen in the direction of firing, for contact against the upper part 47 of trigger blade carrier 15. The two pressure elements 54 are designed in the form of a cushion, for example, from rubber or another elastically compliant material. The impact forces acting between the pendulums 34 and 35 and trigger 14 can be damped by the cushion-like pressure elements 54. The pendulums 34 and 35 are forced against the upper part 47 of the trigger blade carrier 15 through the two compression springs 53 via the cushion-like pressure elements 54.

Due to the implementation and arrangement of the two pendulums 34 and 35 described above, these act as inertial masses and execute a pivoting movement about transverse axis 33 during impacts on trigger housing 12. Because of the different arrangement of the compression springs 53 and pressure elements 54 between the two pendulums 34 and 35 and trigger 14, these act as a multidirectional drop or impact safety whose method of function is explained below with reference to FIGS. 8 to 11.

Figure 8:
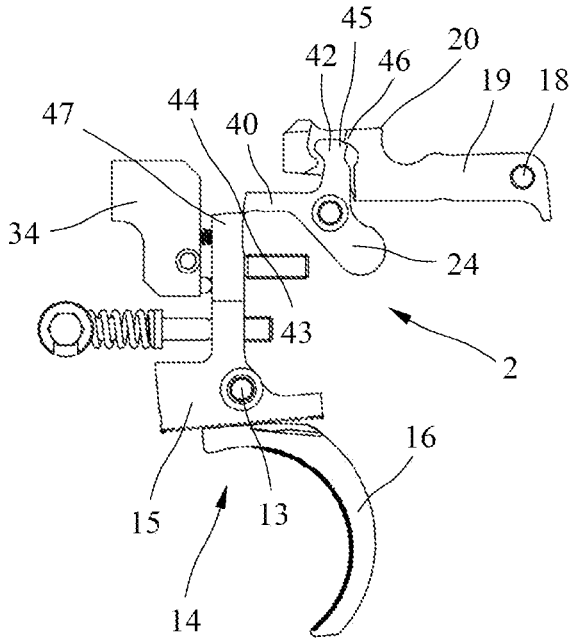
FIG. 8 shows the trigger mechanism shown in FIG. 3 in a cocked position.

The trigger mechanism 2 is shown in FIG. 8 in a cocked position. The rocker-like transfer element 24 lies with its front first stop 43 against the first counter stop 44 on the upper end of the upwardly extending part 47 of trigger blade carrier 15. In this position of the rocker-like transfer element 24, the rear second stop 45 of the rocker-like transfer element 24 engages beneath the second counter stop 46 on sear 19, so that sear 19 is held in the upper holding position. In this upper holding position, the firing pin nut 11 shown in FIGS. 1 and 2 is held by sear stop 20. The two pendulums 34 and 35 are found in an undeflected initial position and are forced via compression springs 53 with their pressure elements 54 against the trigger blade carrier 15 of trigger 14 above the transverse pin 13 serving as pivot for trigger 14.

Figure 9:
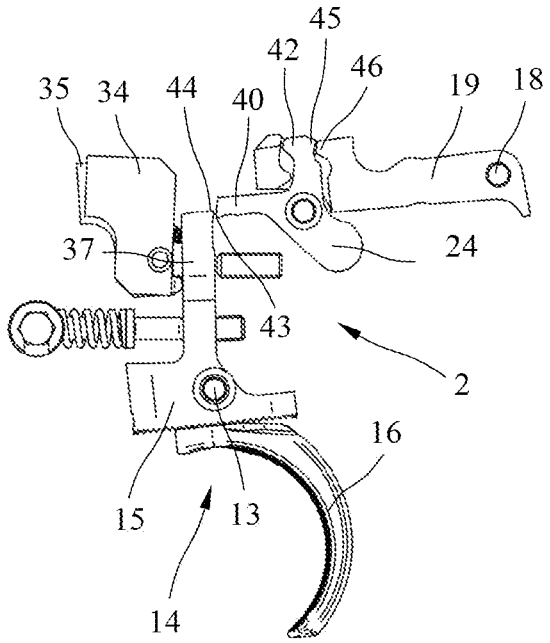
FIG. 9 shows the trigger mechanism shown in FIG. 3 in a half-cocked position.

The trigger mechanism 2 is shown in FIG. 9 with half-cocked trigger 14. By retraction of the trigger latch 16, the first counter stop 44 on the upper end of the trigger blade carrier 15 releases the front first stop 43 on transfer element 24, so that the transfer element 24 can rotate counterclockwise and the front first arm 40 can be moved downward. The second stop 45 on the second arm 42 of transfer element 24 then disengages from the second counter stop 46 on sear 19, so that the sear 19 can be rotated into the lower half-cocked position to release the firing pin 8 acted upon by firing pin spring 9. The two pendulums 34 and 35 are moved in opposite directions by movement of the upward extending part 47 of trigger blade carrier 15.

Figure 10:
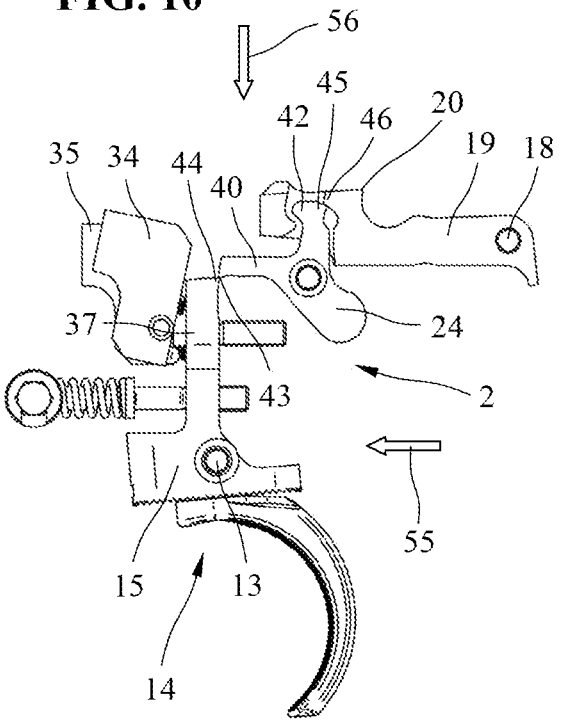
FIG. 10 shows the trigger mechanism shown in FIG. 3 in a cocked position and during impacts from below and above.

If the trigger mechanism 2 in the cocked position as shown in FIG. 10 is subjected to an impact in the direction of arrow 55, caused, for example, by falling or impact on the stock of the repeating weapon or an impact from above in the direction of arrow 56, i.e., an impact occurs on the repeating weapon from the rear or above, the two pendulums 34 and 35 deflect clockwise, in which case the right pendulum 35, as viewed in the direction of firing, presses with its pressure element 54 against the upper part 47 of the trigger blade carrier 15 and holds trigger 13 in its initial position.

Figure 11:
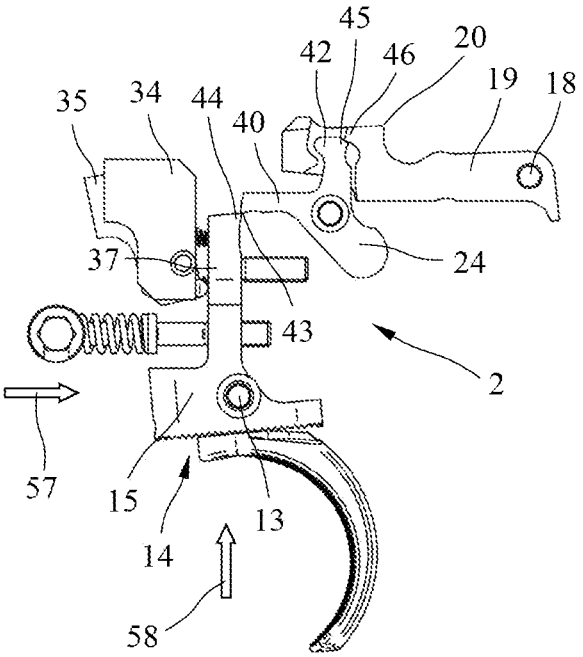
FIG. 11 shows the trigger mechanism shown in FIG. 3 in a cocked position and during impacts from the front and from below.

If, on the other hand, an impact acts on the trigger mechanism 2 in the cocked position, as shown in FIG. 11 in the direction of both arrows 57 and 58, i.e., an impact occurs from below or from the front, the two pendulums 34 and 35 deflect counterclockwise, the right pendulum viewed in the direction of firing deflects, in which case the left pendulum 34 viewed in the direction of firing presses with its pressure element 54 against the upper part 47 of the trigger blade carrier 15 and holds the trigger 13 in its initial position. A force is therefore exerted on the trigger 13 via the two pendulums 34 and 35 during impacts in all directions, which forces the trigger 13 into its initial position.

Figure 12:
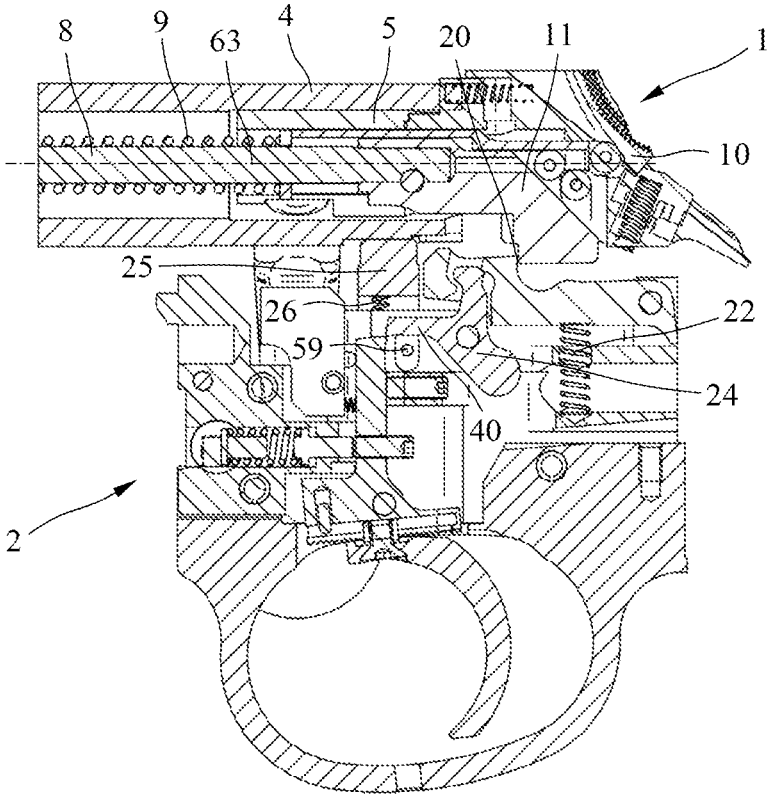
FIG. 12 shows a sectional view of the trigger mechanism in a cocked position with a bolt in the locked position.
Figure 13:
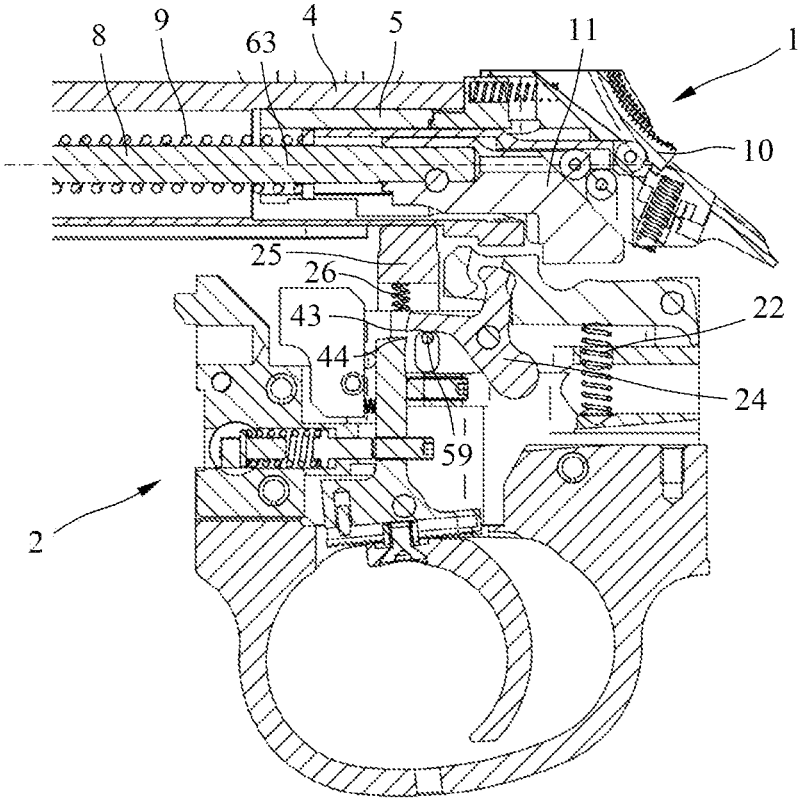
FIG. 13 shows a sectional view of the trigger mechanism with a bolt in the opened position and FIG. 14 shows a sectional view along line A-A of FIG. 1.
Figure 14:
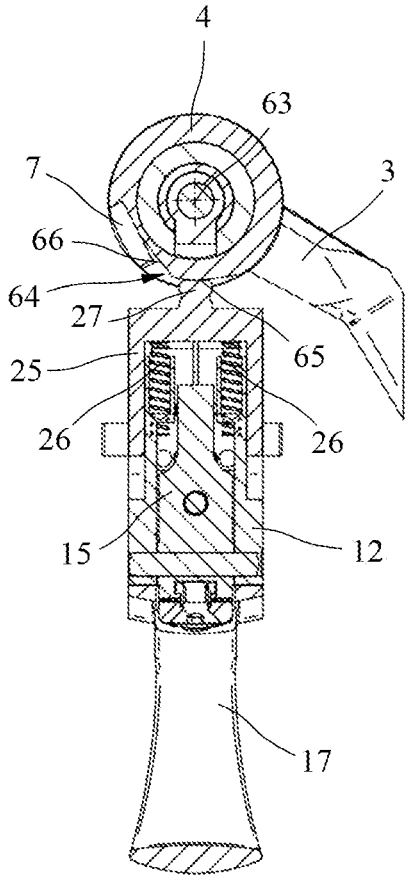

In addition to the drop or impact safety just described, a safety, further depicted in FIGS. 12 to 14, is also attainable via the trigger mechanism 2 to prevent undesired discharge when bolt 1 is unlocked. For this purpose, the breech catch element 25, arranged to move on the top of breech housing 12 transverse to bolt 1, has a blocking element 59, shown in FIGS. 12 and 13, here designed pin-like, which is inserted into two transverse bores 60, shown in FIG. 3 in the two side walls of the fork-like breech catch element 25, and cooperates with the forward protruding arm 40 of the rocker-like transfer element 24 to block or release trigger 14. The transfer element 24 contains a semicircular recess 61 in one of the two side walls, into which the rounded first end of the lever, pivotable about pivot 31, engages. The other rounded second end of lever 30 engages in a semicircular recess 62 on control slide 29.

As shown in FIG. 14, a control cam 64 is provided on the bolt body 4 of bolt 1 rotatable by means of bolt handle 3 about a longitudinal axis 63 between a locked position and a unlocked position and designed as a radial groove on the outside of bolt body 4 to move the breech catch element 25 from a lowered off-safe position into a raised safe position when rotation of bolt body 4, which is caused by the raising of bolt handle 3, occurs into the unlocked position. The control cam 64 has a first control surface 65, against which the upper pin 27 of the breech catch element 25, forced upward by the compression springs 26, comes into contact in a locked position of the bolt body 4 and through which the breech catch element 25 is forced into the off-safe position. The control cam 64 also has a second control surface 66 following the first control surface 65 in the peripheral direction of bolt body 4 and recessed relative thereto, against which the upper pin 27 of the breech catch element 25, forced upward by compression springs 26, comes into contact when bolt body 4 is unlocked and through which the breech catch element 25 reaches the raised safe position.

In the locked position of bolt 1 shown in FIG. 14, the breech catch element 25, forced upward by the two compression springs 26, lies with its upper pin 27 against the first control surface 65 and is pressed downwardly by the latter into the off-safe position shown in FIG. 12. In the off-safe position, the pin-like blocking element 59 is spaced from the bottom of the forward protruding arm 40 of the rocker-like transfer element 24, so that the rocker-like transfer element 24 can be rotated counterclockwise during actuation of trigger 14 and the firing pin nut 11 arranged on the end of the firing pin 8 can be released for half-cocking of the firing pin 8 via the sear stop 20.

If, on the other hand, the bolt handle 3 in the locked position shown in FIG. 14 is raised to unlock bolt 1, and bolt body 4 is therefore rotated counterclockwise, as seen in the direction of firing, pin 27 on the top of the breech catch element 25 contacts the second control surface 66 of control cam 64 offset inward relative to the first control surface 65, so that the breech catch element 25 can be moved upward into the raised safe position under the action of springs 26.

In the completely unlocked position of bolt 1, pin 27 enters the groove 7 of bolt body 4 running in the longitudinal direction, so that the bolt 1 can be pulled rearward for opening of the bolt breech. The groove 7 has a contact surface 67, shown in FIG. 1, on its front to stop the pin 27 of the breech catch element 25. This can prevent the bolt 1 from being completely pulled out of the bolt sleeve 5, 5*a* during repeating. For disassembly of bolt 1 the breech catch element 25 can be moved by the control slide 29 via lever 30 into a lower disassembly position.

LIST OF REFERENCE NUMBERS

1 Bolt
2 Trigger mechanism
3 Bolt handle
4 Bolt body
5 Cylindrical front portion of bolt sleeve
5*a* Triangularly shaped rear portion of bolt sleeve
6 Locking lug
7 Guide groove
8 Firing pin
9 Firing pin spring
10 Cocking slide
11 Firing pin nut
12 Trigger housing
13 First transverse pin
14 Trigger
15 Trigger blade carrier
16 Trigger latch
17 Trigger guard
18 Second transverse pin
19 Sear
20 Sear stop
21 Stop edge
22 Spring
23 Third transverse pin
24 Transfer element
25 Breech catch element
26 Compression spring
27 Pin
28 Guide groove
29 Control slide
30 Lever
31 Pivot
32 Recess
33 Transverse axis
34 First pendulum
35 Second pendulum
36 Trigger spring
37 Pressure pin
38 Spring pin
39 Control element
40 First arm
41 Recess
42 Second arm
43 First stop
44 First counter stop
45 Second stop
46 Second counter stop
47 Upper part of trigger blade carrier
48 Transverse pin
49 Transverse bore
50 Rear end surface
51 Upper blind bore
52 Lower blind bore
53 Compression spring
54 Pressure element
55 Arrow
56 Arrow
57 Arrow
58 Arrow
59 Blocking element
60 Transverse bore
61 Recess
62 Recess
63 Longitudinal axis
64 Control cam
65 First control surface
66 Second control surface
67 Stop surface

The invention claimed is:

1. A repeating weapon, comprising:

a bolt with a bolt body movable between a locked position and an unlocked position and a trigger mechanism with a trigger, a sear movable between a cocked position and a half-cocked position, a transfer element movable by actuation of the trigger between a holding position to hold the sear in the cocked position and a release position to move the sear into the half-cocked position, and a breech catch element movable transverse to the bolt body to limit an axial movement of the bolt during opening, wherein a control cam is arranged on the bolt body to move the breech catch element into a safe position when the bolt body is moved into the unlocked position, and wherein a blocking element cooperating with the transfer element is arranged on the breech catch element to prevent movement of the transfer element into the release position when the breech catch element moves into the safe position.

2. The repeating weapon according to claim 1, wherein the blocking element is arranged on the breech catch element in such a way that the transfer element is spaced from the trigger in the safe position of the breech catch element.

3. The repeating weapon according to claim 1, wherein the transfer element is in a form of a rotatable rocker with a first arm cooperating with the trigger and the breech catch element via the blocking element and a second arm cooperating with the sear.

4. The repeating weapon according to claim 3, wherein a first stop is arranged on the first arm of the transfer element to engage with a first counter stop on the trigger, and a second stop is arranged on the second arm of the transfer element to engage with a second counter stop on the sear.

5. The repeating weapon according to claim 4, wherein the second stop on the second arm of the transfer element and the second counter stop on the sear are designed in such a way that the sear, which is pivotable about a transverse pin, is movable downward into a half-cocked position by a counterclockwise rotation of the transfer element.

6. The repeating weapon according to claim 1, wherein the blocking element is in a form of a blocking pin arranged in transverse bores of the breech catch element.

7. The repeating weapon according to claim 1, wherein the breech catch element is movable by a control slide into a lower disassembly position via a lever.

8. The repeating weapon according to claim 1, wherein the control cam is designed as a radial groove arranged on an outside of bolt body with a control surface to move the breech catch element into the safe position.

9. The repeating weapon according to claim 1, wherein the control cam contains a first control surface to contact the breech catch element in a breech blocking position and a second control surface recessed relative to the first control surface to contact the breech catch element in the safe position raised relative to the breech blocking position.

10. The repeating weapon according to claim 1, wherein the trigger mechanism contains a safety device assigned to the trigger with two pendulums pivotable by impacts, wherein the two pendulums are connected to the trigger in such a way that the trigger is forced by at least one of the two pendulums into an initial position during an excursion of the two pendulums caused by impact.

11. The repeating weapon according to claim 10, wherein the two pendulums are arranged rotatable about a common axis of rotation via a transverse bore and a transverse pin.

12. The repeating weapon according to claim 11, wherein the one of the two pendulums has on a rear end surface, as seen in a direction of firing, a first pressure element offset relative to the common axis of rotation in a first direction for contact against the trigger and a first spring to force the first pressure element against the trigger, and the other of the two pendulums has on a rear end surface, as seen in the direction of firing, a second pressure element offset relative to the common axis of rotation in a second direction opposite the first direction and a second spring to force the second pressure element against the trigger.

13. The repeating weapon according to 12, wherein each of the two pendulums have on the respective rear end surface an upper blind bore arranged above the common axis of rotation and a lower blind bore arranged beneath the common axis of rotation, in each of which a spring and a pressure element are arranged.

14. The repeating weapon according to 12, wherein the first and second springs and the pressure elements of the first and second pendulums lie against an upwardly extending part of a trigger latch support of the trigger rotatable about a transverse pin.

15. The repeating weapon according to 12, wherein the pressure elements are made of rubber or another elastic material.

* * * * *